US011476071B2

(12) United States Patent
Zäuner

(10) Patent No.: US 11,476,071 B2
(45) Date of Patent: Oct. 18, 2022

(54) DISCONNECTING DEVICE FOR A SURGE ARRESTER

(71) Applicant: DEHN SE, Neumarkt/Opf. (DE)

(72) Inventor: Edmund Zäuner, Berching/Pollanten (DE)

(73) Assignee: DEHN SE, Neumarkt i.d.OPf. (DE)

( * ) Notice: Subject to any disclaimer, the term of this patent is extended or adjusted under 35 U.S.C. 154(b) by 63 days.

(21) Appl. No.: 17/251,895

(22) PCT Filed: May 20, 2019

(86) PCT No.: PCT/EP2019/062906
§ 371 (c)(1),
(2) Date: Dec. 14, 2020

(87) PCT Pub. No.: WO2019/242959
PCT Pub. Date: Dec. 26, 2019

(65) Prior Publication Data

US 2021/0125804 A1 Apr. 29, 2021

(30) Foreign Application Priority Data

Jun. 18, 2018 (DE) ..... 102018114564.0

(51) Int. Cl.
*H01H 71/08* (2006.01)
*H01H 71/02* (2006.01)
(Continued)

(52) U.S. Cl.
CPC ..... *H01H 71/08* (2013.01); *H01H 37/761* (2013.01); *H01H 71/02* (2013.01); *H01H 71/10* (2013.01); *H01H 2037/762* (2013.01)

(58) Field of Classification Search
CPC ..... H01H 71/08; H01H 37/761; H01H 71/02; H01H 71/10; H01H 2037/762
(Continued)

(56) References Cited

U.S. PATENT DOCUMENTS 6,040,971 A * 3/2000 Martenson ..... H01C 7/12 361/103
6,430,019 B1 * 8/2002 Martenson ..... H01C 7/126 361/103
(Continued)

FOREIGN PATENT DOCUMENTS

CN 207199392 U 4/2018 ..... H01C 1/00
DE 102006036598 A1 10/2007 ..... H01H 37/76
(Continued)

OTHER PUBLICATIONS

Notification Concerning Transmittal of International Preliminary Report on Patentability (Chapter I of the Patent Cooperation Treaty), in English, dated Dec. 30, 2020, which was issued by the International Bureau of WIPO in Applicant's corresponding international PCT application having Serial No. PCT/EP2019/062906, filed on May 20, 2019.
(Continued)

*Primary Examiner* — Anatoly Vortman
(74) *Attorney, Agent, or Firm* — Bodner & O'Rourke, LLP; Gerald T. Bodner; Christian P. Bodner

(57) ABSTRACT

The invention relates to a disconnecting device for a surge arrester which is accommodated by a support body, and wherein plug contacts which are connected to at least one arrester element of the surge arrester extend from the support body. The invention further comprises a switching tongue which is connected at a first end to the arrester element via a thermal separating point and with a second end to one of the plug contacts. Furthermore, a spring-preloaded insulating disconnecting bracket which is pivotably mounted on the support body is provided, the spring preload acting on the thermal separating point via the switching tongue. According to the invention, the switching tongue is configured as a
(Continued)

straight-surface, elongated, metallic, resiliently elastic disconnecting strip having a rectangular cross-section.

4 Claims, 3 Drawing Sheets

(51) Int. Cl.
*H01H 71/10* (2006.01)
*H01H 37/76* (2006.01)

(58) Field of Classification Search
USPC ..... 337/14, 148, 165
See application file for complete search history.

(56) References Cited

U.S. PATENT DOCUMENTS

| | | | | |
|---|---|---|---|---|
| 7,477,503 | B2 * | 1/2009 | Aszmus | H01C 7/126 361/111 |
| 7,483,252 | B2 * | 1/2009 | de Palma | H01C 7/112 361/127 |
| 7,839,257 | B2 * | 11/2010 | Cernicka | H01C 7/126 337/79 |
| 8,031,456 | B2 * | 10/2011 | Wang | H01C 7/126 361/117 |
| 8,378,778 | B2 * | 2/2013 | Duval | H01C 7/126 361/127 |
| 8,493,170 | B2 * | 7/2013 | Zauner | H01T 1/12 337/147 |
| 8,836,464 | B2 * | 9/2014 | Wang | H01T 1/14 337/5 |
| 9,165,702 | B2 * | 10/2015 | Hagerty | H01C 7/126 |
| 9,172,236 | B2 * | 10/2015 | Hirschmann | H01C 7/126 |
| 9,537,304 | B2 * | 1/2017 | Mao | H02H 9/041 |
| 9,570,260 | B2 * | 2/2017 | Yang | H01H 61/02 |
| 10,014,098 | B2 * | 7/2018 | Hirschmann | H01H 37/76 |
| 10,049,795 | B2 | 8/2018 | Hirschmann et al. | |
| 2012/0068806 | A1 * | 3/2012 | Guarniere | H01C 7/108 361/91.1 |
| 2016/0035523 | A1 * | 2/2016 | Daum | H01H 37/761 337/408 |
| 2016/0134104 | A1 | 5/2016 | Mao | 361/124 |

FOREIGN PATENT DOCUMENTS

| | | | | |
|---|---|---|---|---|
| DE | 102007042991 | A1 | 12/2008 | H01C 7/12 |
| DE | 202014103262 | U1 | 7/2014 | H01T 1/14 |
| DE | 102013019390 | A1 | 4/2015 | H01C 7/12 |
| EP | 2011128 | B1 | 3/2016 | H01H 37/76 |
| JP | S547389 | | 1/1979 | H01R 4/10 |
| JP | 2009534804 | A | 9/2009 | H01H 37/76 |
| JP | 5059099 | B2 | 10/2012 | H01H 37/76 |
| WO | WO2005112050 | A1 | 11/2005 | H01C 7/12 |
| WO | WO2007125000 | A1 | 11/2007 | H01C 7/12 |

OTHER PUBLICATIONS

English translation of the International Preliminary Report on Patentability (Chapter I of the Patent Cooperation Treaty), dated Dec. 22, 2020, which was issued by the International Bureau of WIPO in Applicant's corresponding international PCT application having Serial No. PCT/EP2019/062906, filed on May 20, 2019.

Written Opinion of the International Searching Authority, in English, dated Aug. 23, 2019, which was issued by the International Bureau of WIPO in Applicant's corresponding international PCT application having Serial No. PCT/EP2019/062906, filed on May 20, 2019.

International Search Report, in English, dated Aug. 23, 2019, which was issued by the International Bureau of WIPO in Applicant's corresponding international PCT application having Serial No. PCT/EP2019/062906, filed on May 20, 2019.

Examination Report (in German), dated Feb. 20, 2019, issued by the German Patent Office for Applicant's corresponding German Patent Application No. DE102018114564.0, filed Jun. 18, 2018.

* cited by examiner

DISCONNECTING DEVICE FOR A SURGE ARRESTER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

(1) Field of the Invention

The invention relates to a disconnecting device for a surge arrester, which is accommodated by a support body, and wherein plug contacts which are connected to at least one arrester element of the surge arrester extend from the support body, further comprising a switching tongue, which is connected at a first end to the arrester element via a thermal separating point and with a second end to one of the plug contacts, a spring-preloaded insulating disconnecting bracket which is pivotably mounted on the support body, the spring preload acting on the thermal separating point via the switching tongue, according to the teachings set forth herein.

(2) Description of Related Art

A disconnecting device for a surge arrester is already known from EP 2 011 128 B1. In this disconnecting device, the switching movement is performed by a switching tongue, which is aligned via a permanently acting spring force in the opposite direction to the retention force produced via a protective solder. The permanent preloading force indirectly acting on the switching tongue or the soldering point thereof to generate an unsoldering or switching force via a disconnecting bracket is supported by at least one further preloading force acting independently thereof and by an additional switching force having the same direction of action.

The distribution of forces is produced such that in the rest state, a low resulting force acts on the solder point and a greatest possible resulting force performs the switching movement during the unsoldering process by providing the preloading force in the unsoldering phase by forming the switching tongue from a memory or bimetallic strip or a switching tongue made of a spring material which has a characteristic with an overbent web, and by forming the additional switching force after completion of the unsoldering process by shifting a force transmission point of the preload induced on the switching tongue and the resulting leverage.

The shifting of the force transmission point is derived from a rotary movement, and the disconnecting bracket therefore has a rotary bearing.

The switching movement of the previously known switching tongue results from a spring tension, which indirectly exerts a preload on the switching tongue and thus on the solder contact point via the disconnecting bracket. Due to the rotary movement of the disconnecting bracket, the disconnected switching tongue performs a fast switching movement over a large opening distance and thus creates a safe separation between the arrester element and the wire routing formed by the switching tongue. At the same time, the rotary movement performed by the disconnecting bracket is displayed at the end position thereof in an inspection window, so that the switching position of the disconnecting bracket can be recognized from the outside by means of a display area as the release state.

The solder point connecting the switching tongue to the arrester element is designed and manufactured such that the disconnection takes place in a safe manner and at a point in time when no thermal damage by an overheated arrester element is foreseeable. This point is determined at first by the choice of solder, the described mechanical preload also providing a significant contribution thereto.

A plurality of bending and thus deformation sections which lead to an undesired increase in current density are provided in the switching tongue according to EP 2 011 128 B1. For this reason, the known solution is not suitable for safely absorbing or conducting high surge currents and high short-circuit currents.

In the surge protection element according to DE 20 2014 103 262 U1, which is intended for use between a neutral conductor and a potential equalization in the power supply of a low-voltage mains, this element includes a housing and a surge-limiting component which is arranged in the housing and has two terminal contacts for the electrical connection of a current path to be protected.

Furthermore, an electrically conductive connecting element and an insulating separating element and at least one spring element are present.

A gas-filled surge arrester is used as a surge limiting component, the insulating separating element being arranged displaceably on the housing and being adapted to be moved from a first position to a second position by the force of the at least one spring element.

In the normal state of the surge protection element, the second end of an electrically conductive connecting element is electrically conductively connected to the second electrode of the surge arrester via a thermally breaking connection, and the insulating separating element is fixed in a first position.

If a predetermined limit temperature of the surge protection element is exceeded, the thermal connection between the second end of the electrically conductive connecting element and the second electrode of the surge arrester is broken, and the insulating separating element is moved by the force of the spring element into its second position, in which a section of the separating element is located between the second end of the electrically conductive connecting element and the second electrode of the surge arrester.

The electrically conductive connecting element is configured as an angled metallic strip and thus basically has a high current carrying capacity. The mentioned angle which forms a contact surface which can be connected to the terminal contact is present for the purpose of contacting the conductive connecting element with the second terminal contact. In this respect, a current constriction is also formed in the bend area. A further disadvantage is the straight shifting of the insulating separating element with the risk of canting in the provided slide guide, in particular if a thermal load on the surge arrester has already occurred.

BRIEF SUMMARY OF THE INVENTION

On the basis of the aforementioned, it is the object of the invention to specify a further developed disconnecting device for a surge arrester, which is constructed in a particularly simple manner and can therefore be manufactured at low cost and, with respect to a switching tongue carrying surge or short-circuit currents, is also capable of carrying extremely high surge currents or short-circuit currents.

The solution of the object of the invention is carried out by a disconnecting device according to the combination of features set forth herein.

The disconnecting device for a surge arrester, which is accommodated by a support body, and wherein plug contacts which are connected to at least one arrester element of the surge arrester extend from the support body to the external connection, has a switching tongue, which is connected at a first end to the arrester element via a thermal separating point and with a second end to one of the plug contacts.

Furthermore, the disconnecting device comprises an spring-preloaded insulating disconnecting bracket which is pivotably mounted on the support body, the spring preload acting on the thermal separating point via the switching tongue.

The support body, which accommodates both the arrester element and the actual disconnecting device, is a plastic injection-molded part surrounded by a separate outer housing. The overall arrangement formed in this way can be realized as a plug-in part and thus as an exchangeable surge arrester which can be inserted into a usual lower part having connecting terminals.

Irrespective thereof, the presented disconnecting device according to the invention is also suitable for other types of surge arrester designs having support bodies.

According to the invention, the switching tongue is configured as a straight-surface, elongated, metallic, resiliently elastic disconnecting strip having a rectangular cross section.

The cross-sectional area is realized such that a design for maximum surge currents or maximum short-circuit currents is easily possible.

The connection to a contact surface of the arrester element is made by means of a thermal separating point known per se, for example via a solder connection.

However, according to the invention, the actual thermal separating point is realized via the broadside of a first disconnecting strip end.

The connection to one of the plug contacts, however, is made via the circumference of a second disconnecting strip end which plunges into a slit-shaped recess within a section of the plug contact facing the support body.

In this respect, the recess is substantially complementary to the cross-sectional area of the second disconnecting strip end.

The second disconnecting strip end is therefore inserted into the recess having a rectangular cross-section and fixed there, for example by an intermaterial bonding.

When the melting point of the thermal separating point is reached, the disconnecting bracket is subject to a shift in position, more specifically due to the spring preload.

This causes the disconnecting strip to be lifted from the contact point with the first disconnecting strip end thereof. The disconnecting bracket then enters the resulting gap and leads to a safe disconnection.

The development of a possible arc is thereby reliably prevented or suppressed from the beginning.

The disconnecting bracket itself is configured as a rotating lever. The axis of rotation is here located at an end opposite the point of application for generating the spring preload, resulting in a corresponding force amplification to the position of the thermal separating point located between the axis of rotation and the point of application for the spring preload.

The shift in position of the disconnecting bracket can be seen through an inspection window in an outer housing enclosing the support body, so that the respective state of the surge arrester can be understood.

In one configuration of the invention, a guiding lug is integrally formed with the support body to accommodate the second disconnecting strip end.

In a development of the invention, the second disconnecting strip end is soldered or welded to the plug contact.

Again as a development, the disconnecting bracket is designed as a rotary slide and is provided with a flattening in the form of a simple bevel or a wedge face on its edge facing the thermal separating point. This ensures a fast and safe separation of the contact surfaces connected by solder, exploiting the elasticity of the switching tongue designed as a disconnecting strip. During the disconnecting movement, the disconnecting strip is only stressed in its elastic area. Plastic deformations do not occur and are not necessary on the manufacturing side.

Due to the forces acting on the thermal separating point with increased leverage, blockages caused by solder residues or rough material surfaces or other unevenness that may occur during the melting process can be overcome.

The invention will be explained in more detail below with reference to an example embodiment and with the aid of the figures in which:

BRIEF DESCRIPTION OF THE SEVERAL VIEWS OF THE DRAWING(S)

DETAILED DESCRIPTION OF THE INVENTION

Figure 1:
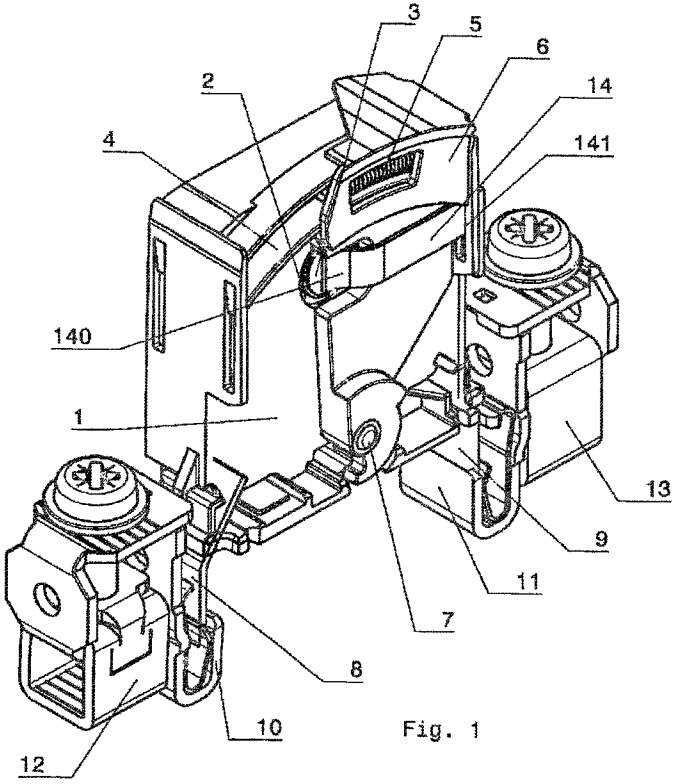
FIG. 1 shows a perspective view of a plug-in part of a surge arrester without outer housing and without lower part, but with outer electrical screw connecting terminals in the operational, i.e. not disconnected state.
Figure 2:
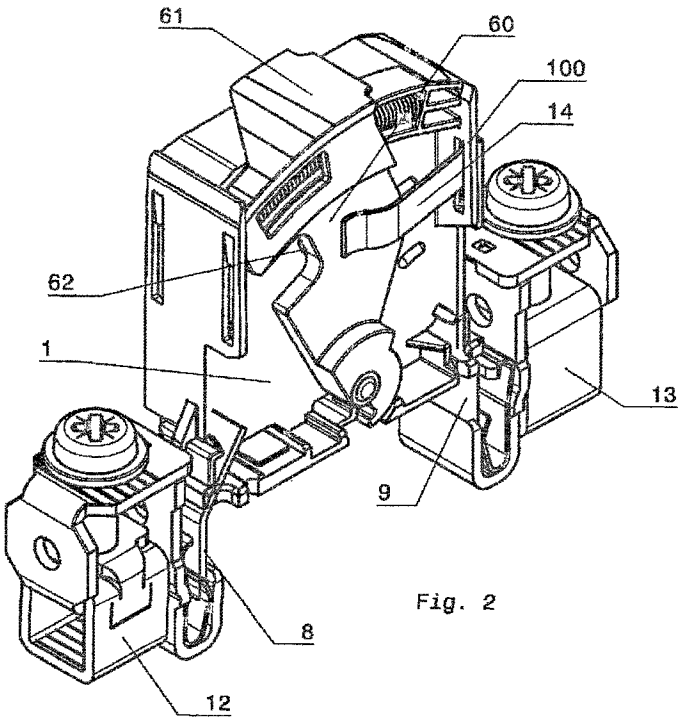
FIG. 2 shows a representation similar to that shown in FIG. 1, but in the disconnected state, wherein here, the disconnecting bracket has already shifted in position and plunged into the gap between the contact point and the disconnecting strip.

The disconnecting device according to the invention in accordance with the example embodiment may be part of a surge arrester in the form of a plug-in part, as indicated in FIGS. 1 and 2.

Here, the shown plug-in part does not yet have an outer housing in order to make the design and function of the disconnecting device clear.

The plug-in part has a support body 1, which on one side includes a chamber-like recess having at least one arrester element.

The support body has an opening 2, which allows access to a contact point 3 of the arrester element.

The thermal separating point known per se is realized in this area.

Furthermore, the support body 1 has a curved guide 4 to accommodate a spring 5 which generates a preload force. It should also be noted that the spring 5 is supported at one end on a stop of an insulating disconnecting bracket 6 which is formed as a rotary slide.

The rotary slide is located on a axis of rotation 7, which may be configured as an extension and thus as an integral element of the support body 1.

External connections of the surge arrester can be configured as plug contacts 8; 9, which engage in U-shaped mating contacts 10 and 11.

The mating contacts 10 and 11 are connected to or are part of external connection screw terminals 12 and 13 known per se.

According to the invention, the switching tongue of the thermal separating point is configured as a straight-surface, elongated, metallic, resiliently elastic disconnecting strip 14.

The connection to the contact surface 3 of the arrester element is made, as explained, by means of the thermal separating point, more specifically via the broadside of a first disconnecting strip end 140.

In contrast thereto, the connection to one of the plug contacts 9 is made via the circumference of a second disconnecting strip end 141, which plunges into a slot-shaped recess 15 in an extension section 16 of the plug contact 9.

Here, the recess 15 corresponds substantially to the cross-sectional area of the second disconnecting strip end 141 and is configured so as to be complementary to this end.

Figure 3:
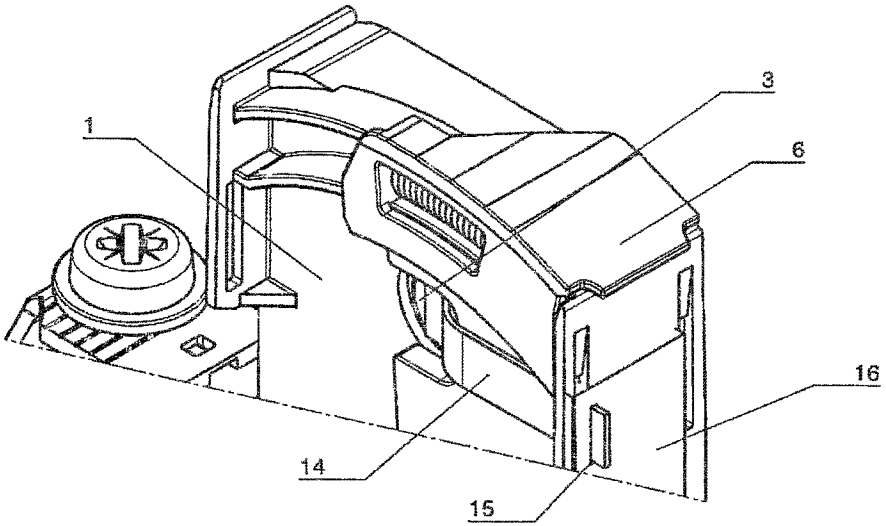
FIG. 3 shows a detailed view for forming the connection of one of the plug contacts via the circumference of a second disconnecting strip end, which plunges into a slot-shaped recess within a section of the plug contact which faces the support body.

A corresponding detailed representation can be seen in FIG. 3.

When the melting point of the thermal separating point is reached, the disconnecting bracket 6 is subject to a shift in position; this can be seen in FIGS. 1 and 2 by a movement to the left.

The first disconnecting strip end 140 of the disconnecting strip lifts off from the contact point 3. Furthermore, the area 60 of the disconnecting bracket 6 enters the resulting gap (see FIG. 2).

The shift in position of the disconnecting bracket 6 can be seen through an inspection window not shown in the figures in an outer housing not shown which encloses the support body 1.

In this respect, a display surface 61 is integrally formed with the disconnecting bracket 6.

As shown in FIGS. 1 and 2, the disconnecting bracket 6 is formed as a rotary slide. At its edge 62 facing the thermal separating point, the disconnecting bracket 6 may have a flattening in the form of a bevel or wedge surface to optimize the penetration into the separating point area and the disconnecting process.

What is claimed is:

1. A disconnecting device for a surge arrester which is accommodated by a support body, and wherein plug contacts which are connected to at least one arrester element of the surge arrester extend from the support body, further comprising a switching tongue which is connected at a first end to the arrester element via a thermal separating point and with a second end to one of the plug contacts, a spring-preloaded insulating disconnecting bracket which is pivotably mounted on the support body, the spring preload acting on the thermal separating point via the switching tongue, wherein the switching tongue is configured as a straight-surface, elongated, metallic, resiliently elastic disconnecting strip having a rectangular cross-section, a connection to a contact surface of the arrester element being made by means of the thermal separating point via the broadside of a first disconnecting strip end, and a connection to one of the plug contacts being made via a circumference of a second disconnecting strip end which plunges into a slot-shaped recess within a section of the plug contact which faces the support body, the recess being substantially complementary to a cross-sectional area of the second disconnecting strip end, and the disconnecting bracket being further subject to a shift in position when a melting point of the thermal separating point is reached, and thus lifting the disconnecting strip with the first disconnecting strip end thereof from the contact point, and the disconnecting bracket entering a resulting gap.

2. The disconnecting device according to claim 1, wherein the disconnecting bracket is configured as a rotary lever.

3. The disconnecting device according to claim 1, wherein a guiding lug is integrally formed with the support body to accommodate the second disconnecting strip end.

4. The disconnecting device according to claim 1, wherein the second disconnecting strip end is soldered or welded to the plug contact.

* * * * *